United States Patent [19]

Sexton

[11] Patent Number: 4,971,665

[45] Date of Patent: Nov. 20, 1990

[54] METHOD OF FABRICATING ORIFICE PLATES WITH REUSABLE MANDREL

[75] Inventor: Richard W. Sexton, Dayton, Ohio

[73] Assignee: Eastman Kodak Company, Rochester, N.Y.

[21] Appl. No.: 451,849

[22] Filed: Dec. 18, 1989

[51] Int. Cl.[5] ..... C25D 1/08

[52] U.S. Cl. ..... 204/11

[58] Field of Search ..... 204/11

[56] References Cited

U.S. PATENT DOCUMENTS

| | | | |
|---|---|---|---|
| 2,221,502 | 11/1940 | Van de Pol | 204/11 |
| 3,582,476 | 6/1971 | Knisley | 204/11 |
| 4,184,925 | 1/1980 | Kenworthy | 204/11 |
| 4,246,076 | 1/1981 | Gardner | 204/11 |
| 4,374,707 | 2/1983 | Pollack | 204/11 |

*Primary Examiner*—T. M. Tufariello

*Attorney, Agent, or Firm*—John D. Husser

[57] ABSTRACT

A method of fabricating an orifice plate for ink jet printing includes the steps of: (i) providing a reusable mandrel having an electrically conductive bottom surface of an oxidizable metal such as aluminum and integral raised relief portions comprising an oxide of the metal (e.g. aluminum oxide) and (ii) electroforming metal onto said mandrel conductive surfaces to form an orifice plate.

2 Claims, 2 Drawing Sheets

FIG. 1
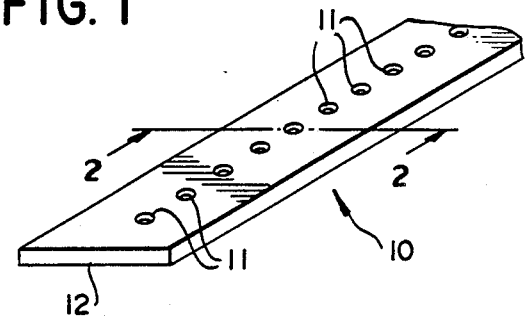
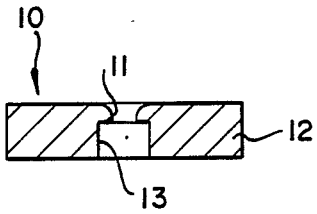
FIG. 2
FIG. 3
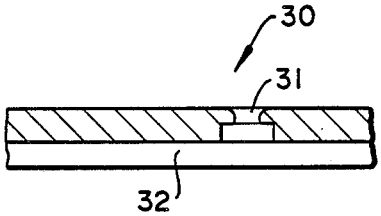
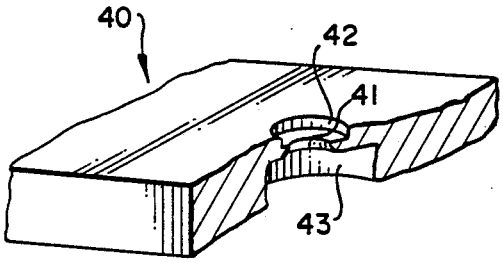
FIG. 4
FIG. 5
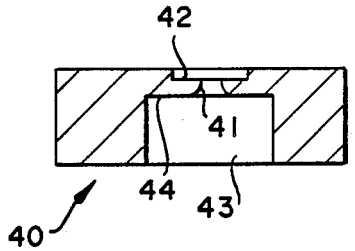

METHOD OF FABRICATING ORIFICE PLATES WITH REUSABLE MANDREL

FIELD OF INVENTION

The present invention relates to a method of fabricating orifice plate devices of the kind useful in ink jet printing, and more particularly, to methods for electroforming such devices with an improved reusable mandrel element.

BACKGROUND ART

In ink jet printing, of both the continuous and drop-on-demand approaches, it is necessary to have orifice plate devices that define relatively precise drop ejection passages to form drops of the desired size and direction. The orifice plate devices often comprise a plurality of drop ejection orifices that must be located in a precise interrelation. The orifice plates should be durable, e.g. resistant to chemical reaction with the ink and to wear.

The currently most popular way to accomplish the above objectives is to electroform the orifice plate devices, e.g. by electroplating. U.S. Pat. No. 4,184,925 discloses a highly desirable method to effect such electroforming. In the '925 patent method, cylindrical photoresist pegs are photofabricated on portions of the surface of an electrically conductive metal mandrel. The pegs have a diameter slightly larger than the desired orifice diameter and are inter located at the desired orifice spacings. The peg bearing mandrel is then placed in a conventional electroplating system which is activated so that nickel is deposited onto the conductive mandrel surface, but not upon the dielectric photoresist peg tops. Plating is continued until the thickness of the formed layer reaches the tops of the pegs and then slightly beyond to cause the formed layer to grow over the periphery of the peg tops to an extent that achieves the precise orifice diameter that is wanted.

At this stage the orifice plate can be removed from the mandrel, or its thickness can be increased by forming additional photoresist structures over the formed orifices and electroplating additional material. U.S. Pat. Nos. 4,246,076 and 4,374,707 describe similar electroplating procedures using different photoresist topography to achieve various desired orifice cross sections. U.S. Pat. No. 4,528,577 discloses that such photoresist topography can be used to electroform elements defining ink baffles as well as the orifices.

While the above described electroforming methods have been successfully used for producing commercial devices for some time, there remain problems with the methods. First, the photoresist topography structures (e.g. pegs) are normally usable only for the formation of a single orifice plate so that mandrels must be reimaged with the desired topography as a part of each fabrication sequence. Also, the photoresist portions of the mandrel vary slightly in geometry during each reimage, causing orifices of less than uniform dimension. Further, the photoresist pegs are sometimes defective. For example, small particles from the air sometimes adhere to the photoresist and because of the microscopic size of the pegs. This can cause lower yields for the fabrication process.

SUMMARY OF INVENTION

One significant purpose of the present invention is to provide a fabrication method which avoids the above noted disadvantages of prior art methods and provides a method for electroforming orifice plate devices of improved quality and output yield. The fabrication method of the present invention is also advantageous, in simplifying the fabrication procedure, by providing a mandrel having reusable topography.

The present invention constitutes improvements in ink jet orifice plate fabrication methods of the kind that include electroplating upon a mandrel having an electrically conductive bottom surfaces and dielectric raised relief portions. In one aspect such improvements include constructing the dielectric raised relief portions of the mandrel as anodized oxides of its metal bottom surface.

BRIEF DESCRIPTION OF DRAWINGS

The subsequent description of preferred embodiments refers to the accompanying drawings wherein:

FIG. 1 is a perspective view showing one orifice plate device which can be constructed by methods according to the present invention;

FIG. 2 is a cross-section of the FIG. 1 orifice plate device;

FIG. 3 is a cross-section of another orifice plate device which can be constructed in accord with the present invention;

FIG. 4 is a fragmentary perspective view of another orifice plate device which can be constructed in accord with the present invention;

FIG. 5 is a cross section of the FIG. 4 orifice plate device; and

DETAILED DESCRIPTION OF PREFERRED EMBODIMENTS

Figure 6A:
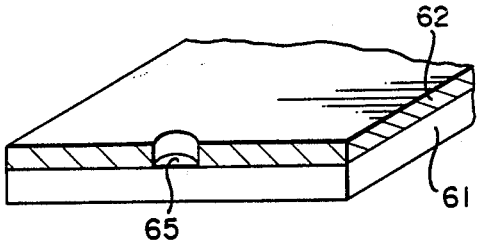
FIGS. 6—A through 6—E are schematic views illustrating steps of one preferred method according to the present invention.

FIGS. 1–5 illustrate different orifice plate configurations that can be constructed according to the present invention. FIG. 1 shows a linear array orifice plate 10 of the kind useful in continuous ink jet printing. The orifice apertures 11 are defined by electroformed nickel or nickel alloy 12 which has been plated to overlie a bore region 13 as described in U.S. Pat. No. 4,184,925.

FIG. 3 discloses an integral orifice plate device 30 having integral baffle elements useful, e.g. in drop-on-demand printing. As described in U.S. Pat. No. 4,525,577, the device 30 comprises a plurality of orifices 31 similar to those in FIG. 2 and a plurality of baffle elements 32 which extend to separate the orifice feed channels to minimize crosstalk. The orifice plate and separator baffles are integral, all comprising electroplated metal, e.g. nickel or nickel alloy.

FIGS. 4 and 5 show another orifice plate construction 40 of the kind described in U.S. Pat. No. 4,184,925. In this device the orifice 41 is defined by overplating a top recess portion 42, and a supply bore 43 is formed by a subsequent masking and plating on surface 44.

Figure 6B:
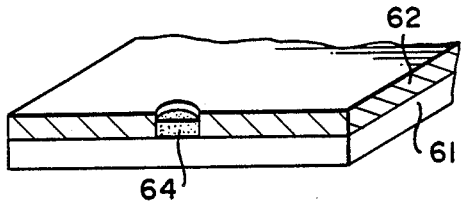
Figure 6C:
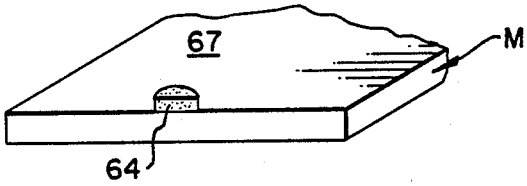
Figure 6D:
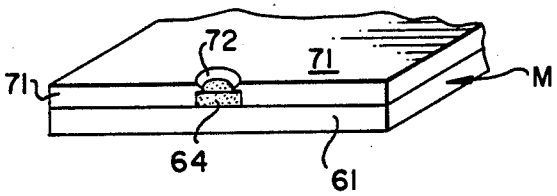
Figure 6E:
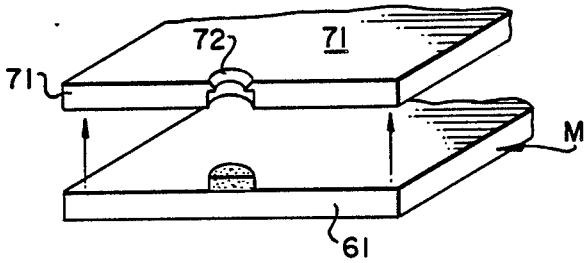

One preferred method for fabricating the orifice plates according to the present invention is illustrated schematically in FIGS. 6–A through 6–E. The method of the present invention involves, as a first sub process, the fabrication of a reusable mandrel M such as shown, in one completed embodiment, in FIG. 6–C. Two of the sub process stages in forming the mandrel M are shown in FIGS. 6–A and 6–B. Thus, a mandrel base 61 of an anodizable metal, e.g. aluminum or aluminum alloy, is first coated with a negative photoresist layer 62 which is dried, exposed to a positive light image of the desired mandrel topography pattern and developed. The exposed portion of the photoresist is removed, by conventional procedures, to provide a cylindrical cavity 63 that conforms in dimension to the desired positive relief peg component 64 of the completed mandrel (shown in FIG. 1–C).

Next, the composite shown in FIG. 6–A is placed in an anodizing system, e.g. containing sulfuric acid solution, and electrolytic activity is energized in the anodizing system to form an oxide on the exposed surface(s) 65 of the panel 61. Anodizing action is allowed to continue until a peg of the desired height is formed comprising the panel metal oxide e.g., aluminum oxide. The process is now at the stage shown in FIG. 6–B and one skilled in the art will understand that the exposed surfaces of oxide peg 64 will constitute a smooth, dense, but non-conducting, integral extension of the electrically conductive panel surface 67.

Next, the photoresist layer 62 is removed by by immersion in a suitable organic solvent (e.g. acetone) leaving a reusable mandrel such as shown in FIG. 6-C. The mandrel M comprises electrically conductive base panel 61 have electrically conductive surfaces 67 and dense non conductive peg 64 formed as an integral oxide part of the metal surface.

Next the reusable mandrel is placed in an electroplating bath and a bright nickel orifice plate 71 is plated onto the conductive surfaces 67 thereof. As described in U.S. Pat. No. 4,184,925, electroplating is allowed to continue until edges form around the periphery of the top of peg 64 to define the orifice opening 72, as shown in FIG. 6–D.

Finally, the orifice plate 71 is removed from the reusable mandrel M as a finished article as shown in FIG. 6–E. Mandrel M can thereafter be replated a number of times to repeat the FIGS. 6–D to 6–E sequences without the necessity of reforming the toPography of the mandrel.

In one specific example, a negative pattern comprising a plurality of predeterminedly located 3.6 mil diameter pegs was formed on an aluminum alloy panel using KTFR (Kodak Thin Film Resist) or KTI 752 Negative Resist, made by Union Carbide Corp. The opening thus formed was anodized in a conventional sulfuric acid solution at 22 volts for 25 minutes to form about 1 mil thickness of aluminum oxide. The photoresist was removed and bright nickel was plated onto the aluminum surface to a thickness of 1.5 mils. The nickel foil was peeled from the surface, producing an orifice plate.

One skilled in the art will understand that various other configurations, e.g. like those shown in FIGS. 3–5 can be fabricated using reusable mandrels formed according to the present inventions. Also, it will be appreciated that other metal or metal alloy base panels (e.g. titanium alloy or magnesium alloy) can be used to form oxide topography and similar reusable mandrels.

The invention has been described in detail with particular reference to certain preferred embodiments thereof, but it will be understood that variations and modifications can be effected within the spirit and scope of the invention.

I claim:

1. A method for electroforming an orifice plate device for use in ink jet printing, said method comprising:

(a) forming on the surface of an anodizable metal panel a photoresist pattern that has smooth-surfaced, cylindrical cavity regions corresponding to the electroforming mandrel topography for an orifice plate device;

(b) anodizing the exposed portions of said metal panel to form dense, smooth-surface, metal oxide peg structures which extend above said metal panel surface and within the open regions of said photoresist pattern;

(c) removing the photoresist pattern from said anodized panel; and (d) electroplating orifice plate metal onto non-annodized panel portions so that the metal is deposited to a thickness equal to or slightly greater than the height of said peg structures.

2. The invention defined in claim 1 wherein said metal surface is aluminum or aluminum alloy and said peg structures comprise aluminum oxide.

* * * * *